US005680964A

United States Patent [19]

Wardle

[11] Patent Number: 5,680,964

[45] Date of Patent: Oct. 28, 1997

[54] LIQUID DISPENSER FLOW CALMING

[75] Inventor: David G. Wardle, Tadworth, England

[73] Assignee: The BOC Group plc, Windlesham, England

[21] Appl. No.: 521,935

[22] Filed: Aug. 31, 1995

[30] Foreign Application Priority Data

Sep. 21, 1994 [GB] United Kingdom ..... 9419055

[51] Int. Cl.[6] ..... B67D 5/62

[52] U.S. Cl. ..... 222/146.6; 62/50.1; 222/189.06; 222/504; 222/518

[58] Field of Search ..... 222/72, 146.6, 222/189.06, 504, 518; 62/50.1

[56] References Cited

U.S. PATENT DOCUMENTS

| | | | |
|---|---|---|---|
| 1,840,079 | 1/1932 | Bradley | 222/72 X |
| 2,171,687 | 9/1939 | Lancey | 222/72 X |
| 2,171,707 | 9/1939 | Logan et al. | 222/72 X |
| 3,961,918 | 6/1976 | Johnson | 55/170 |
| 4,546,609 | 10/1985 | Roullet et al. | 62/49 |
| 4,976,754 | 12/1990 | Edelstein et al. | 55/159 |

FOREIGN PATENT DOCUMENTS

| | | |
|---|---|---|
| A2 0 128 556 | 6/1984 | European Pat. Off. . |
| A 0 271 031 | 12/1987 | European Pat. Off. . |
| 7200176 | 5/1972 | France . |
| 2 092 552 | 8/1984 | United Kingdom . |
| 2 251 296 | 9/1992 | United Kingdom . |

*Primary Examiner*—Joseph Kaufman

*Attorney, Agent, or Firm*—R. Hain Swope; Roger M. Rathbun

[57] ABSTRACT

A liquid cryogen dispenser 10 includes a consolidation structure 20 adjacent its outlet 14 for causing gas contained in the liquid to consolidate into bubbles of sufficient buoyancy to cause them to rise to the surface of the liquid rather than be drawn through the outlet 14 where they can disrupt the smooth flow of liquid cryogen therefrom.

4 Claims, 3 Drawing Sheets

LIQUID DISPENSER FLOW CALMING

The present invention relates to apparatus for calming the flow of liquid and relates particularly, but not exclusively, to apparatus for calming the flow of cryogenic liquids being dispensed from liquid dispensers used on bottle or canning lines.

BACKGROUND OF THE INVENTION

Presently known liquid cryogen dispensers include those described in GB 2092552 and GB 2251296, both of which include an insulated tank of liquid nitrogen provided with a valve on its inside bottom surface and an actuator linked for operating the valve as and when required. The actuator is operated at up to 1000 cycles per second so as to produce a stream of liquid droplets for directing into the mouth of bottles or cans. Each droplet is directed into the bottle or can and at least partially vaporizes to displace any air in the headspace thereby preventing oxidation of the product contained therein. In another application, excess liquid nitrogen is directed into cans of beer before sealing thereby pressurizing the can and increasing its resistance to crushing or other external damage. In this instance, commonly known as the "draught system", some of the nitrogen dissolves into the beer and improves head retention.

From the above, it will be appreciated that it is extremely important to ensure that exactly the right amount of liquid nitrogen is dispensed into each bottle or can. Too little nitrogen could result in the structural integrity of the thin-walled container being compromised or product oxidation taking place whilst too much nitrogen could cause excess internal pressure or excess frothing when the can is opened.

It has been observed that the accuracy of apparatus such as described above is greatly dependant upon the quality of the liquid being dispensed. The difference between the vaporizing pressure of the liquid cryogen and the pressure at which it is stored within the tank results in small quantities of gas being held in solution. It is this gas which, when passed through the outlet, causes blockages and disrupts the steady flow of liquid to such an extent that the flow can be restricted, or even stopped, for short periods of time. In accordance with the present invention, an improved liquid dispenser is provided which substantially reduces the problems associated with the above-mentioned apparatus.

SUMMARY OF THE INVENTION

The present invention provides a dispenser for dispensing drops or streams of cryogenic liquid comprising a vessel for holding cryogenic liquid having an outlet orifice for allowing liquid cryogen to drain from said vessel, characterized by consolidation means adjacent its outlet for causing gas dissolved in the liquid or bubbles held therein to combine into larger bubbles susceptible of removal from the region of the outlet orifice thereby avoiding bubbles and/or dissolved gas being passed to the outlet.

DETAILED DESCRIPTION OF THE PREFERRED EMBODIMENTS

The dispenser for dispensing drops or streams of cryogenic liquid in accordance with the present invention comprises a vessel for holding cryogenic liquid having an outlet orifice for allowing liquid cryogen to drain from said vessel, characterized by consolidation means adjacent the outlet for causing gas dissolved in the liquid or bubbles held therein to combine into larger bubbles. The larger bubbles thus formed can be removed from the region of the outlet orifice thereby avoiding the presence of bubbles and/or dissolved gas in the liquid being passed to the outlet.

Preferably, the consolidation means comprises a structure having a plurality of apertures for the passage of liquid therethrough and a plurality of structured portions upon which gas dissolved in the liquid or small bubbles coalesce thereby forming said larger bubbles. In a particularly advantageous arrangement, the consolidation means comprises a tube, said tube surrounding said outlet and extending away from said outlet such that an open end of the tube is positioned generally above said outlet.

Conveniently, the consolidation means may comprise a gauze, e.g. a metal gauze, having apertures in the range of from about 20 micrometers to 100 micrometers, preferably about 70 micrometers. Alternatively, the consolidation means may comprise metal wool.

Figure 1:
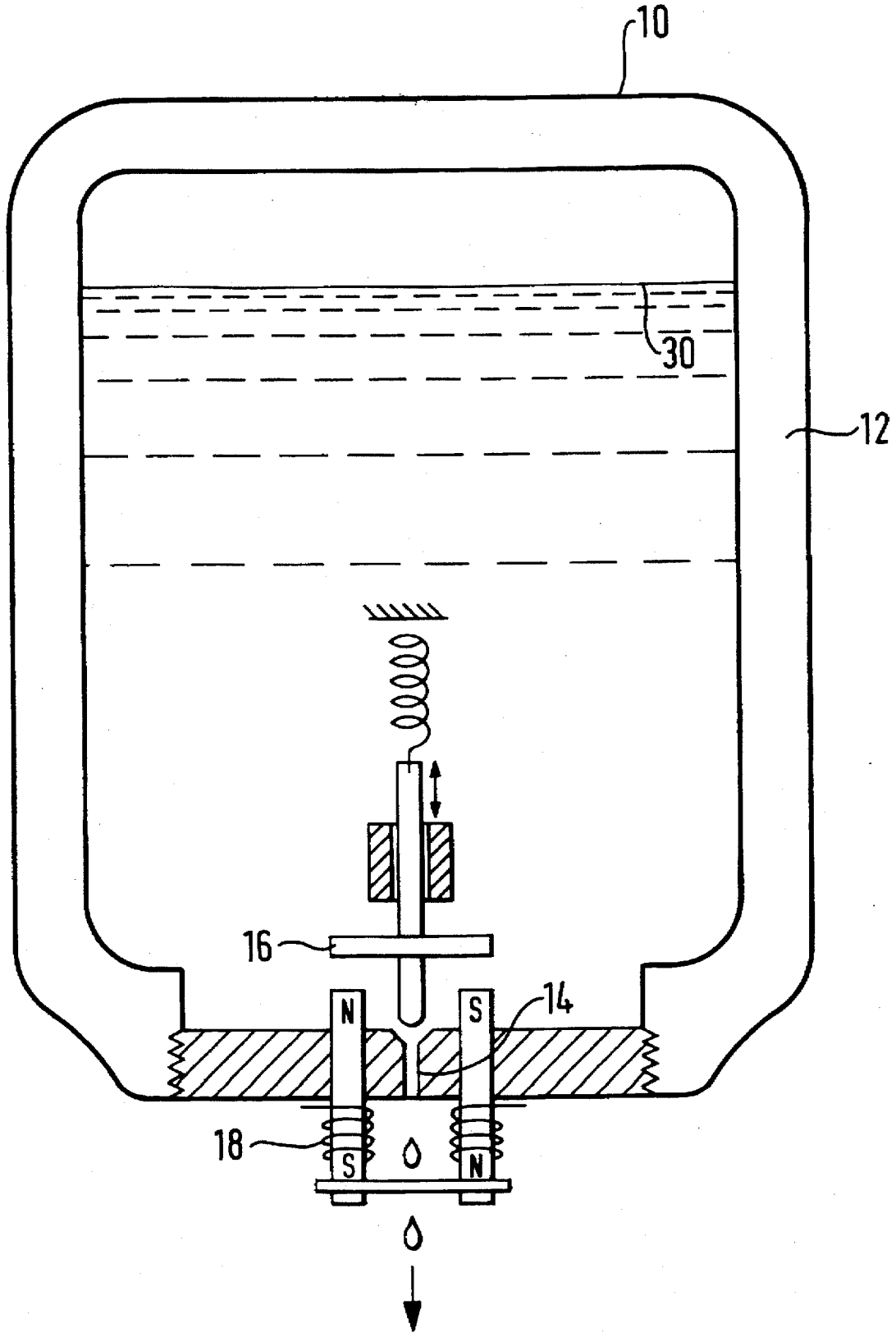
FIG. 1 is a cross sectional view of a known liquid cryogen dispenser.

The present invention will now be more particularly described, by way of example only, with reference to the accompanying drawings. Referring to FIG. 1, a liquid cryogen dispenser 10 comprises an insulated tank 12 for containing said cryogen having an outlet 14 and a valve assembly 16 associated with the outlet for controlling the flow rate of cryogen. An actuator, for example an electro-magnetic actuator 18, is linked to the valve for initiating and controlling the operation thereof. It will be appreciated that the valve assembly 16 and actuator 18 may be of any suitable form and, therefore, are not described in detail herein. A particularly suitable arrangement is described in detail in our co-pending U.S. patent application Ser. No. 08/492,682 filed Jun. 20, 1995, the disclosure of which is incorporated herein by reference. In operation, dispenser causes a fine stream of drops of cryogen to be dispensed from outlet 14 for directing towards a bottle or can in a bottle or canning line (not shown). The dispenser operates at up to, and often beyond, 1000 cycles per minute.

It has been observed that liquid cryogen being dispensed from a dispenser of the type illustrated in FIG. 1, can contain an undesirably large quantity of gas and/or bubbles. This gas or bubbles, when passed through the outlet 14, tends to cause blockages and disrupts the steady flow of liquid cryogen to such on extent that the flow can be restricted, or even stopped, for short periods of time. It will be appreciated that any stoppage or restriction of flow will result in inaccurate or uneven quantities of cryogen being dispensed. Indeed, at high speed operation, it is clearly possible that the apparatus would fail to dispense any cryogen into some of the bottles or cans passing below it.

Figure 2:
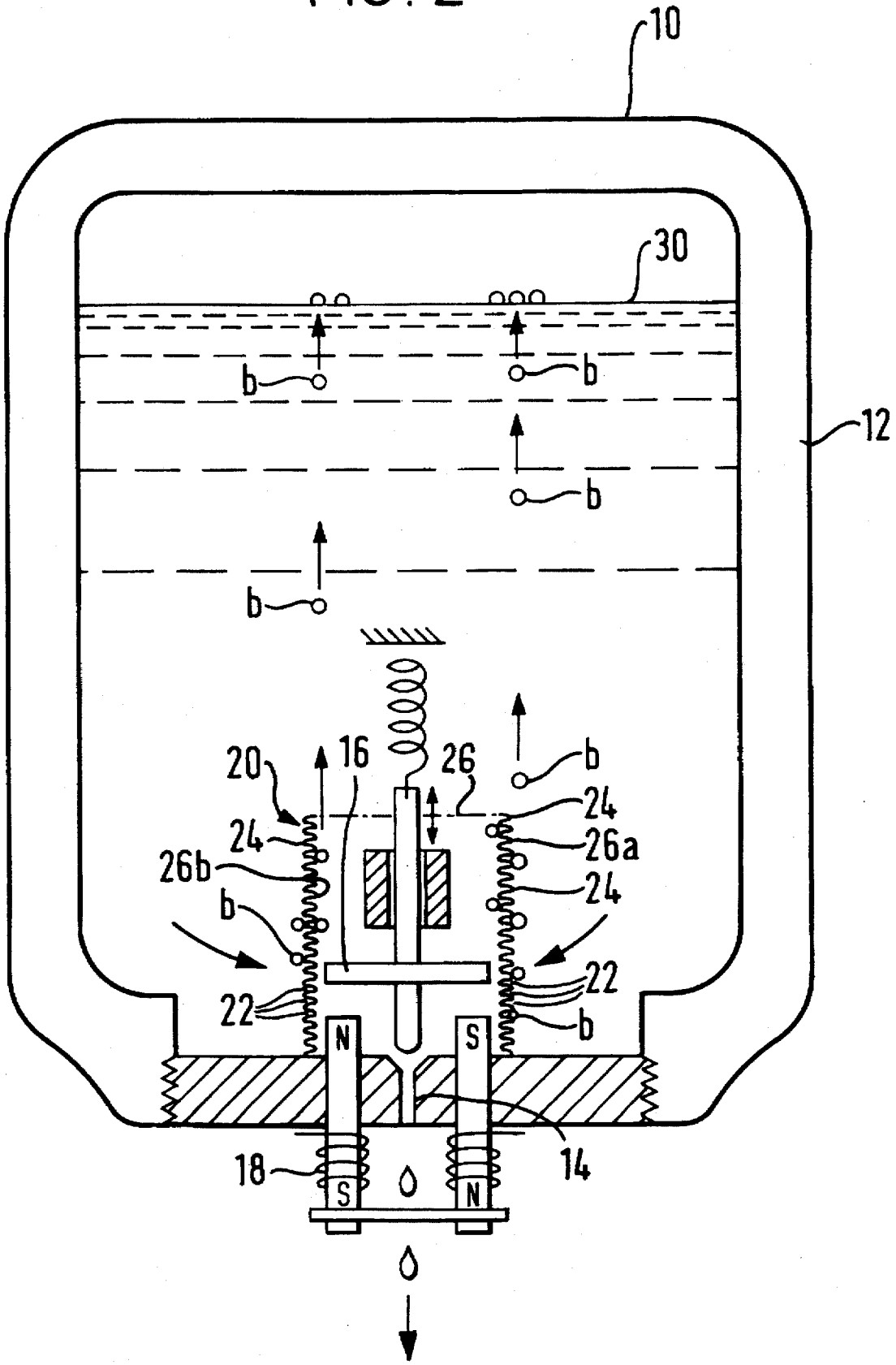
FIGS. 2 and 3 are cross sectional views of liquid cryogen dispensers according to first and second embodiments of the present invention.
Figure 3:
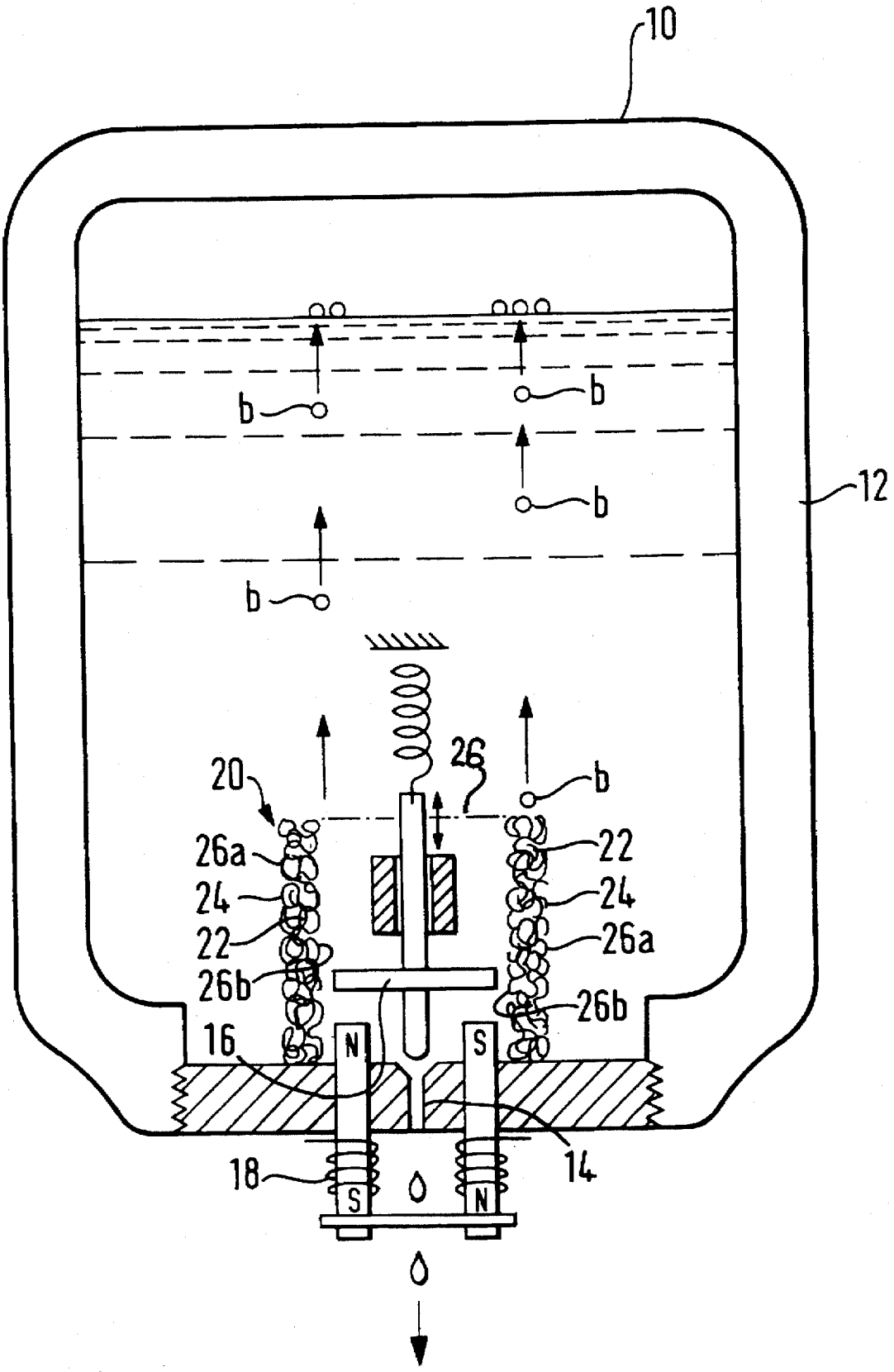

The problem of uneven or interrupted dispensing of liquid cryogen as described above is overcome in accordance with the present invention by a consolidation means illustrated in FIGS. 2 and 3. In the FIG. 2 embodiment, the consolidation means 20 comprises a structure, for example a wire mesh or metal gauze, having a plurality of apertures 22 for the passage of liquid therethrough and a plurality of structural portions 24 upon which gas is consolidated. The apertures 22 are preferably in the range of from about 20 micrometers to 100 micrometers, most preferably about 70 micrometers. The consolidation means 20 takes the form of an open-ended tube having one end placed over the outlet 14 and the other end positioned thereabove so as to define a wall surrounding the outlet 14.

Referring to FIG. 2, it will be seen that the consolidation means 20 comprises a tube of gauze or mesh having an open upper end 26 through which liquid cryogen is free to pass in large quantities and having an inner surface 26*b* and an outer surface 26*a*. The gas in the liquid passing through opening 26 is attracted to the consolidation means 20 and coalesces on inner surface 26*b*. It has been found that covering the opening 26 substantially reduces the effectiveness of the consolidation means 20 as any bubbles formed on the inner surface 26*b* are unable to escape and are eventually drawn through the outlet 14. Clearly, the consolidation means 20 may comprise any one of a number of suitable materials such as, for example, steel wool as shown in FIG. 3. The large number of interior cavities in the consolidation means 20 shown in FIG. 3 effectively acts as "low energy sites".

In operation, liquid cryogen being drawn through outlet 14 will naturally pass through, or close to, the consolidation means 20. Large bubbles b within the liquid will be unable to pass therethrough and will begin to collect on the outer surface 26*a* of consolidation means 20 where they will remain until they combine with other bubbles and gain sufficient buoyancy to cause then to break away from the consolidation means 20 and rise to the surface 30 of the liquid cryogen. Smaller bubbles might pass through the apertures 22 but are attracted to the non-wettable inner surface 26*b* of the gauze/mesh. These will remain and be combined in the same manner as described above. Dissolved gas is similarly attracted to the non-wettable surfaces of consolidation means 20, is taken out of solution and formed into bubbles b which are removed from the region of the outlet 14 in the manner described. In essence, the consolidation means 20 acts as a "low energy site", that is to say a site which acts to attract bubbles/dissolved gas due to the energy imbalance between the bubble/dissolved gas and the surface of the consolidation means 20. Clearly, the more "sites" one provides the better and hence an open cellular structure or woven structure is particularly useful. The cavities or intricate passages in such structures also act to provide a physical restraint, effectively trapping the bubbles until they obtain sufficient buoyancy to break away and rise to the surface 30. Consolidation takes place on both the inner and outer surfaces 26*b*, 26*a*, respectively, of consolidation means 20.

I claim:

1. A dispenser for dispensing drops of cryogenic liquid comprising a vessel for holding said cryogenic liquid having an outlet orifice for allowing liquid cryogen to drain therefrom, characterized by having consolidation means positioned upstream of the outlet orifice comprising a tube adjacent to and surrounding said outlet, and extending upstream therefrom such that an open end of the tube is positioned generally above said outlet, said tube having a plurality of apertures for the passage of liquid therethrough and a plurality of structured portions upon which gas or small bubbles coalesce thereby causing gas dissolved in the liquid or bubbles held therein to combine thereon into larger bubbles susceptible of removal from the region of the outlet orifice, thereby avoiding bubbles and dissolved gas from being passed through said outlet.

2. A dispenser in accordance with claim 1, wherein said consolidation means is a metal gauze and the apertures therein are from about 20 micrometers to about 100 micrometers.

3. A dispenser in accordance with claim 2, wherein said apertures are about 70 micrometers.

4. A dispenser in accordance with claim 1, wherein said consolidation means comprises metal wool.

* * * * *